US007055654B2

(12) United States Patent
Gasseling

(10) Patent No.: US 7,055,654 B2
(45) Date of Patent: Jun. 6, 2006

(54) OIL FILTER COOLER

(76) Inventor: John B. Gasseling, 500 East Blvd., Rapid City, SD (US) 57701

( * ) Notice: Subject to any disclaimer, the term of this patent is extended or adjusted under 35 U.S.C. 154(b) by 665 days.

(21) Appl. No.: 09/948,377

(22) Filed: Sep. 5, 2001

(65) Prior Publication Data

US 2003/0042077 A1 Mar. 6, 2003

(51) Int. Cl.
*F01M 5/00* (2006.01)

(52) U.S. Cl. ..... 184/6.22; 123/196 AB

(58) Field of Classification Search ..... 184/6.22, 184/104.1, 104.2, 104.3; 210/186; 165/80.1, 165/916; 123/41.33, 196 A, 196 AB
See application file for complete search history.

(56) References Cited

U.S. PATENT DOCUMENTS 1,849,042 A * 3/1932 Pickard et al. ..... 210/186
2,191,490 A * 2/1940 Mitterer ..... 137/338
2,358,933 A * 9/1944 Lance ..... 210/186
2,834,469 A * 5/1958 Mitterer ..... 210/181
3,887,467 A * 6/1975 Johnson ..... 210/186
4,717,472 A * 1/1988 Oberg ..... 210/90
5,095,971 A * 3/1992 Hehl ..... 165/47
5,203,832 A * 4/1993 Beatenbough et al. ..... 165/41
5,351,664 A * 10/1994 Rotter et al. ..... 123/196 AB
5,718,281 A * 2/1998 Bartalone et al. ..... 165/41
5,740,772 A * 4/1998 Bluma ..... 123/196 AB
5,901,670 A * 5/1999 Moroi et al. ..... 122/26

FOREIGN PATENT DOCUMENTS

DE 4322979 A1 * 1/1995
EP 773054 A1 * 5/1997

* cited by examiner

*Primary Examiner*—Chong H. Kim

(57) ABSTRACT

An oil filter cooler that has an arrangement of circular fins that are permanently incorporated into the top of an oil filter. These fins allow for an increase of heat dissipation of motor oil as it flows through the oil filter thereby, reducing the temperature of the motor oil.

1 Claim, 2 Drawing Sheets

OIL FILTER COOLER

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention is an oil filter cooler for internal combustion engines that mountes directly to the engine block. The oil filter cooler removes heat from a hot liquid, such as motor oil. This process is known as conduction convection.

The prior art involves oil coolers which are installed on an existing oil filter, or the oil filter cooler is comprised of more than one part to be assembled to make one complete oil filter cooler as one unit. The problem with the prior art of an oil cooler is that it has to be installed on the oil filter and could dislodge during operation. An additional problem is that the oil cooler is adding more material to the outside surface of the oil filter, thereby creating the opposite of the desired endeavor. It is creating less heat transfer, and making the problem worse.

In the case of the prior art oil filter cooler, it is a complex unit of parts to be assembled to make one unit, thereby increasing the manufacturing cost. Some oil filter coolers have fins on the side of the oil filter cooler that create a clearance problem with the engine block and surrounding body. This decrease in clearance reduces air circulation, thereby making the oil filter cooler less effective in the process of heat transfer.

The present invention solves these problems by incorporating fins on the top of an oil filter during the manufacturing process. This process could be stamping, molding, casting or machining. One simple complete unit for an oil filter cooler. An oil filter cooler with fins on top allows for improved clearance, air circulation increasing heat transfer, and easy to install.

BRIEF SUMMARY OF THE INVENTION

The present invention is an oil filter cooler. It is the principal object of the present invention to reduce the temperature of motor oil by manufacturing a new design of oil filters that have circular fins incorporated on the top of the oil filter. These circular fins start in the center and continue outward with an increase in diameter and stopping at the outer top edge of the oil filter. This is a big advantage over existing oil coolers in that, you just install the oil filter cooler to the engine block in a one step process. There is no need to attach a secondary oil cooler to the oil filter or the engine as is the case with current oil coolers.

Applying fins to an oil filter increases the thermal conductivity of the oil filter, increasing the temperature dissipation of the motor oil as it passes through the oil filter. This invention would give an added protection factor against engine failure due to motor oil breakdown.

DETAILED DESCRIPTION OF THE INVENTION

To give an accurate understanding of the present invention on the process of heat transfer by fins can be found in the publication "Heat Transfer", Holman, Sixth Edition, McGraw-Hill, 19869 pp. 43–49. By applying a finned arrangement to another surface can be used to remove heat from a hot liquid. This process is known as conduction convection. It is the principle object of this invention to reduce the temperature of motor oil by this process of conduction convection.

Figure 1:
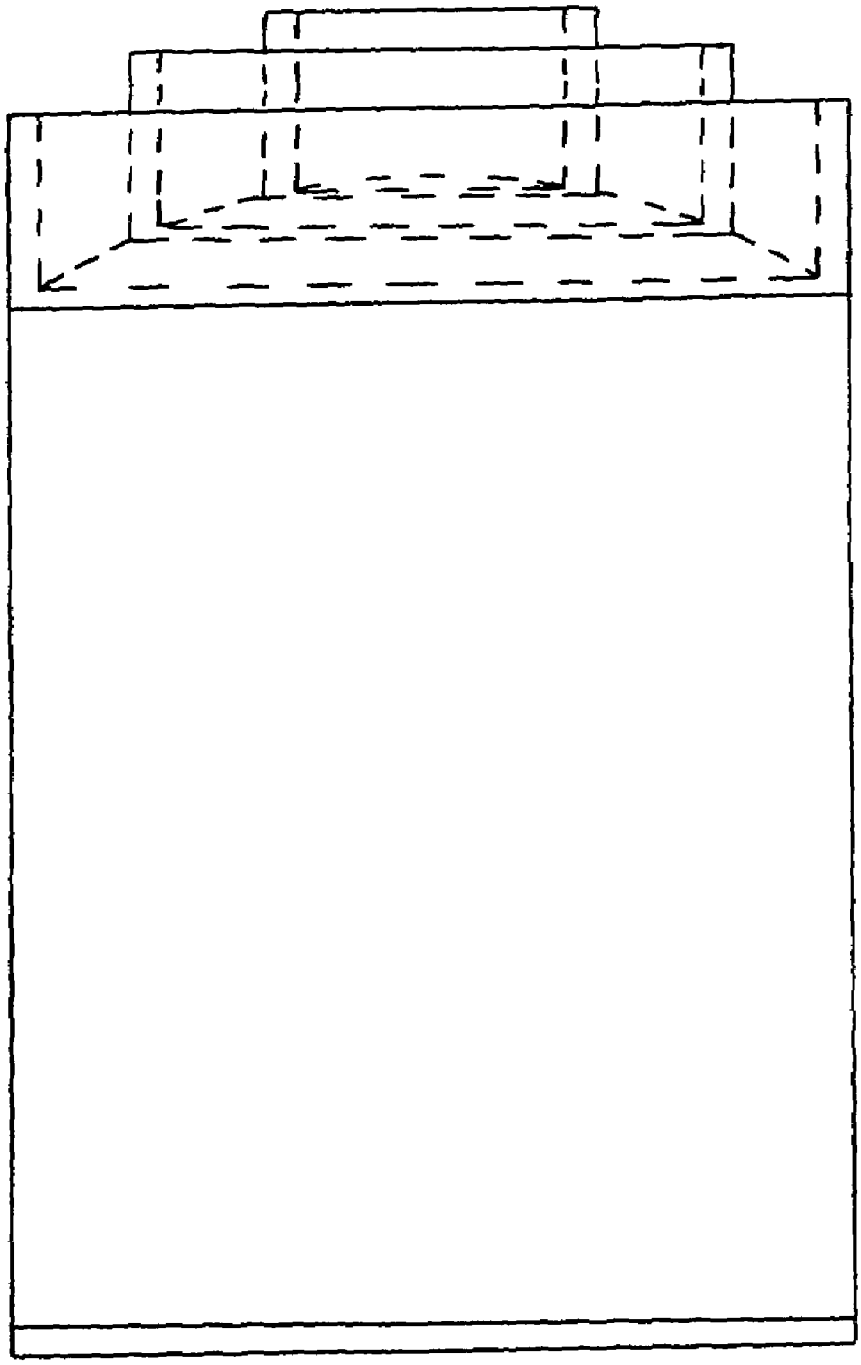
FIG. 1 is a side perspective of the present invention comprising the top of an oil filter cooler 7.

Specifically, the present oil filter cooler has a circular arrangement of fins incorporated on the top of an oil filter 3, FIG. 1. These circular fins start in the center and increase in diameter 8, 9 as they extend to the outer top edge of the oil filter 5, 10. The fins are rectangular in shame from bottom 5 to top 6. The oil filter cooler is screwed to the engine block the same way an oil filter is used for internal combustion engines.

Figure 2:
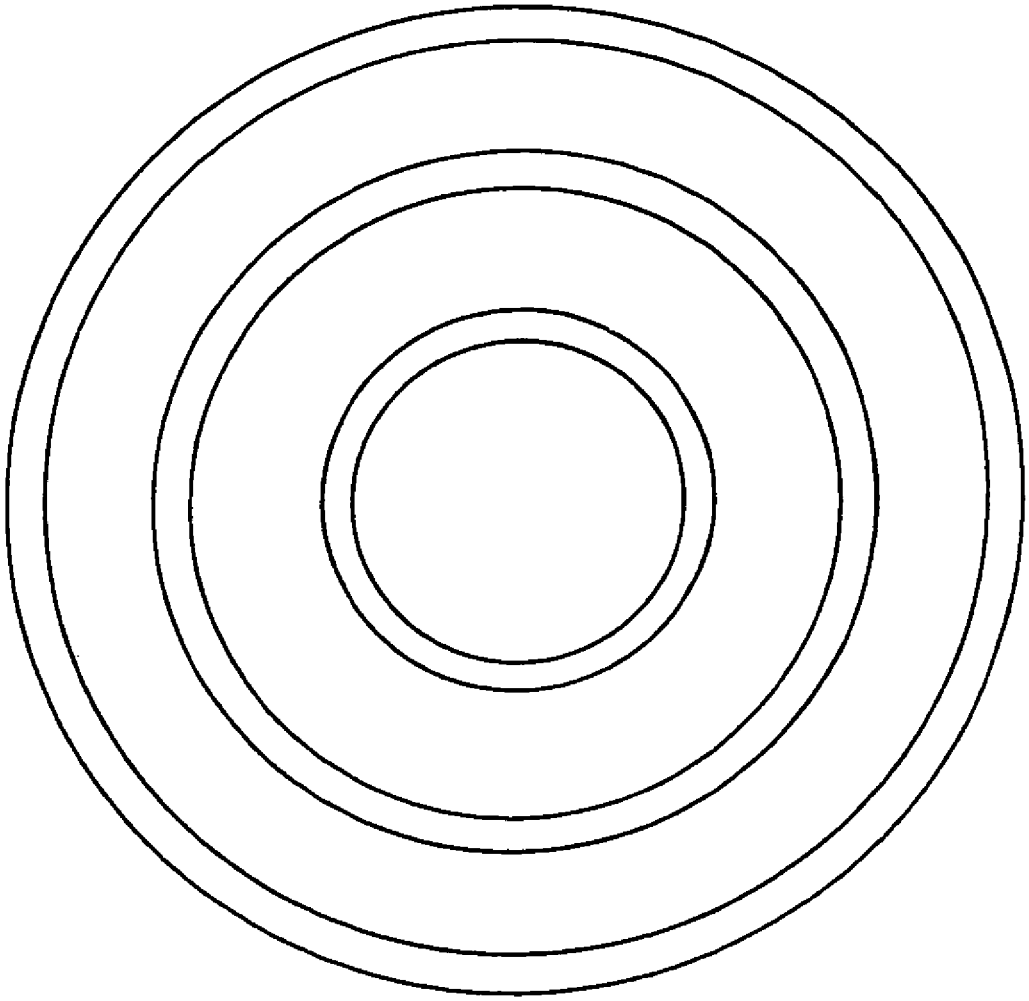
FIG. 2 is a top perspective of the oil filter cooler.
Figure 1:
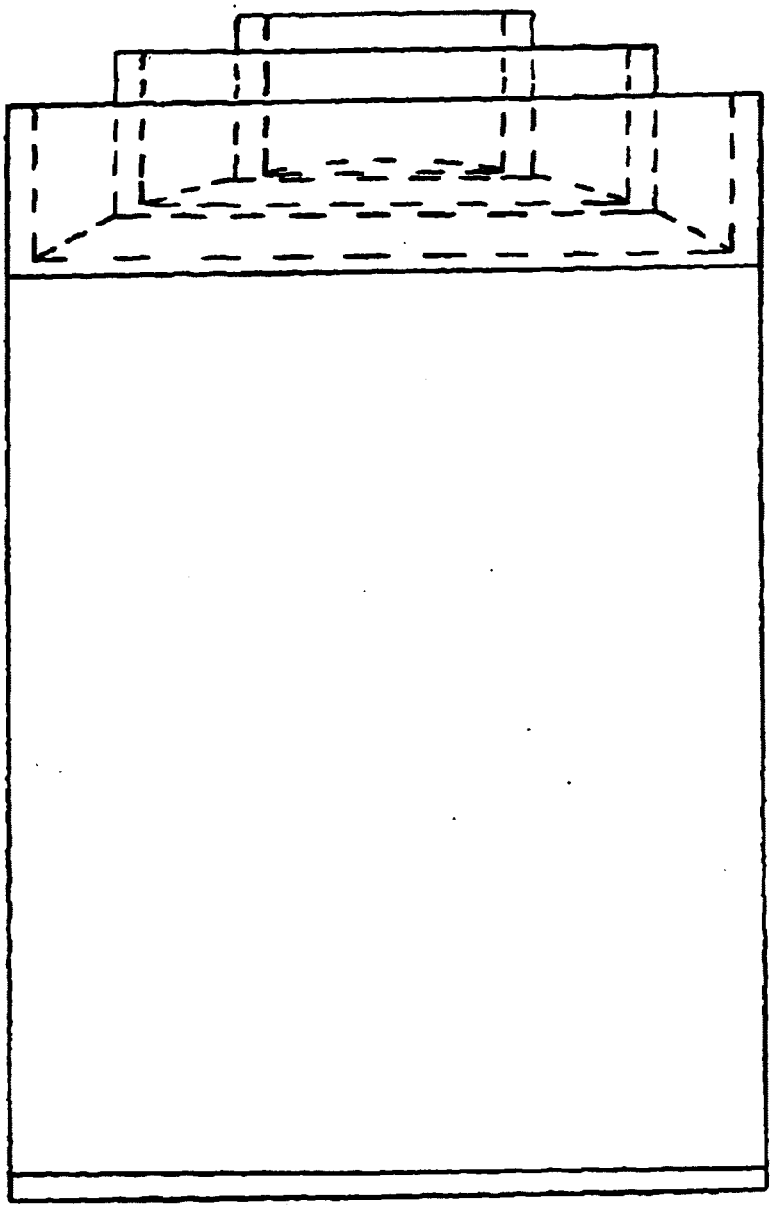
Figure 2:
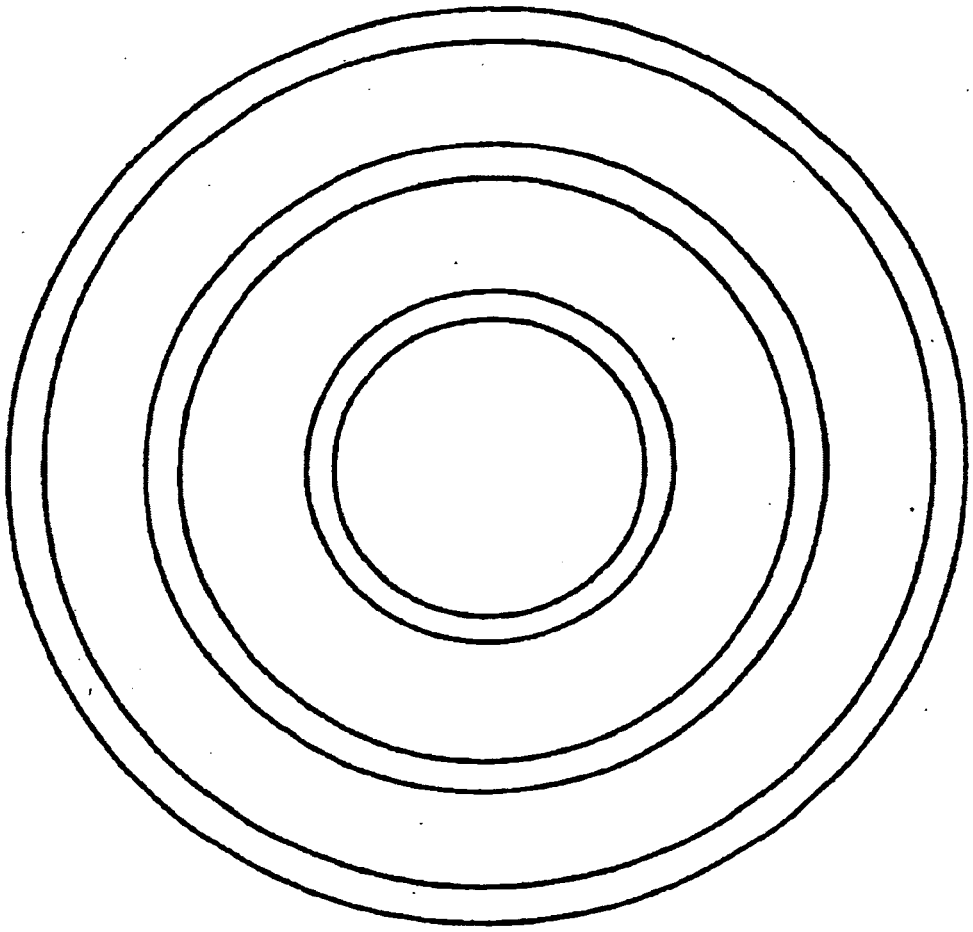
Figure 1:
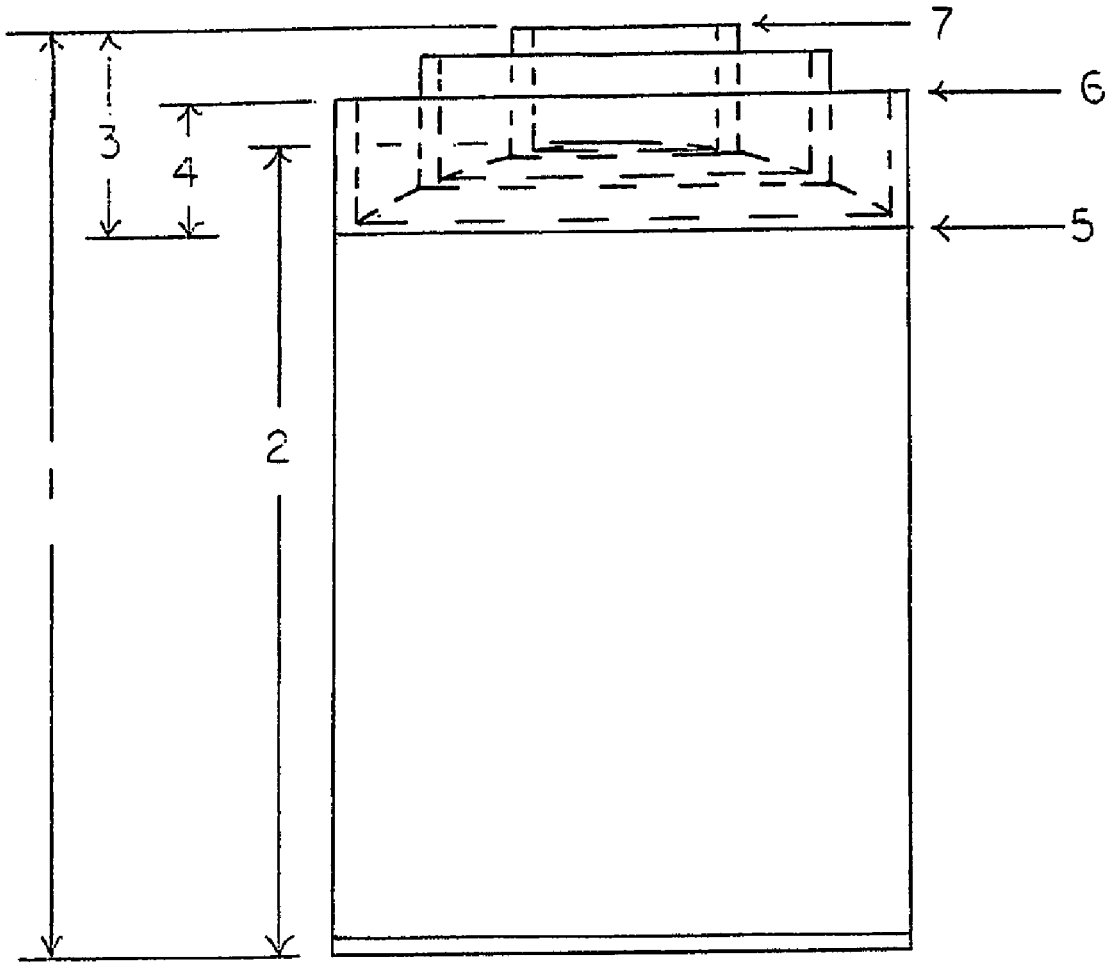
Figure 2:
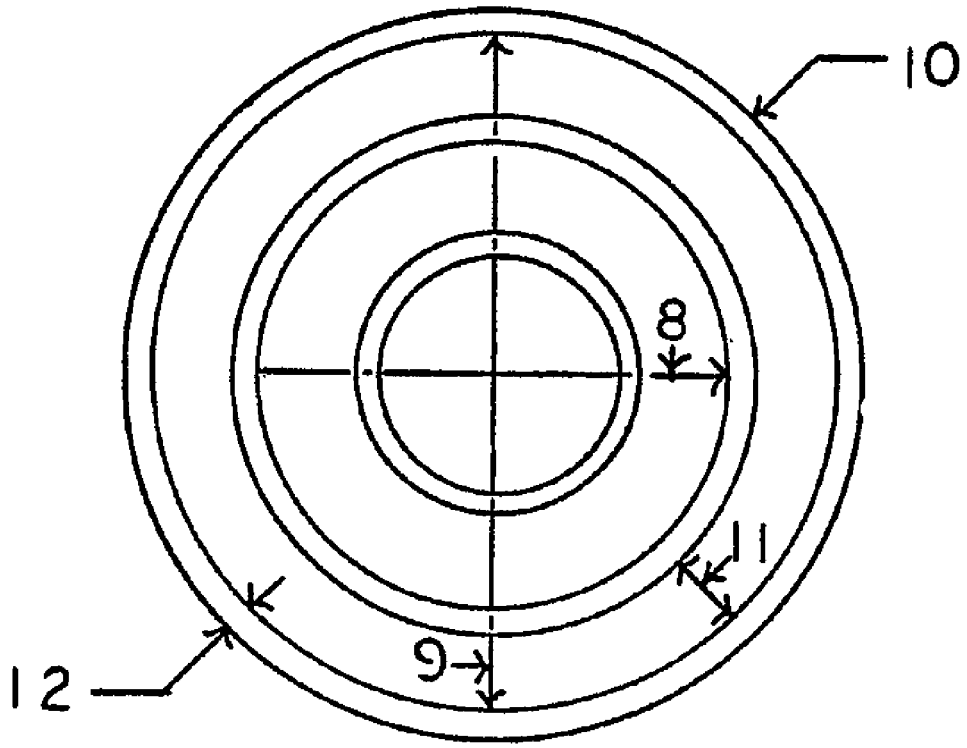

The present invention of the oil filter cooler distinguishes itself from other inventions in that, it is a one piece unit FIG. 1. No assembly required. It is a new oil filters an oil filter 2 and oil cooler 1. The standard oil filter is improved by incorporating fins 3 that are limited to the top of the oil filter cooler FIG. 1. The number of circular fins will vary do to the different sizes of oil filters. The fins are of a rectangular shape as shown in FIG. 1 and FIG. 2. For optimum heat removal the spacing between the fins should not be less than 0.125 inches 11. The length of the fins 4 can be increased or decreased to accommodate for ease of installation, and optimum heat removal. The width 12 of the fins according to "Heat Transfer", Holman, Sixth Edition, McGraw-Hill, 19869 pp. 43–49 will be determined based on the thickness of the outer wall of the oil filter cooler. Another source for fin dimensions can be found under U.S. Pat. No. 5,305,824; Apr. 26, 1994, Gasseling.

DETAILED DESCRIPTION OF THE INVENTION

Materials for manufacturing the present invention can be made of aluminum, iron, tin or other alloys. The best material will be based on cost, and conduction convection properties.

The process of manufacturing the oil filter cooler could be stamping, molding, casting, machining, or a combination of these processes.

The fins are in a circular arrangement FIG. 2 to allow for accident free installation and removal of the oil filter cooler.

I claim:

1. An oil filter for cooling oil comprising: circular fins permanently incorporated and limited to the top of an oil filter, wherein said circular fins are 360 degrees starting in the center and increasing in diameter to the outer top edge, wherein said circular fins are rectangular in shape from bottom to top.

* * * * *

UNITED STATES PATENT AND TRADEMARK OFFICE

CERTIFICATE OF CORRECTION

PATENT NO. : 7,055,654 B2
APPLICATION NO. : 09/948377
DATED : June 6, 2006
INVENTOR(S) : John B. Gasseling It is certified that error appears in the above-identified patent and that said Letters Patent is hereby corrected as shown below:

The title page should be deleted and substitute therefore the attached title page as shown on the attached title page.

Drawings:

Delete drawing sheets 1-2 and substitute therefore the drawing sheets, consisting of Figs. 1-2 as shown on the attached pages.

Col. 2 line 10, should read -- 1986 --

Col. 2 line 20, should read -- SHAPE --

Col. 2 line 40, should read -- 1986 --

Signed and Sealed this

Twenty-sixth Day of September, 2006

JON W. DUDAS
*Director of the United States Patent and Trademark Office*

(12) United States Patent
Gasseling

(10) Patent No.: US 7,055,654 B2
(45) Date of Patent: Jun. 6, 2006

(54) OIL FILTER COOLER

(76) Inventor: John B. Gasseling, 500 East Blvd., Rapid City, SD (US) 57701

( * ) Notice: Subject to any disclaimer, the term of this patent is extended or adjusted under 35 U.S.C. 154(b) by 665 days.

(21) Appl. No.: 09/948,377

(22) Filed: Sep. 5, 2001

(65) Prior Publication Data

US 2003/0042077 A1 Mar. 6, 2003

(51) Int. Cl.
*F01M 5/00* (2006.01)

(52) U.S. Cl. ..... 184/6.22; 123/196 AB

(58) Field of Classification Search ..... 184/6.22, 184/104.1, 104.2, 104.3; 210/186; 165/80.1, 165/916; 123/41.33, 196 A, 196 AB
See application file for complete search history.

(56) References Cited

U.S. PATENT DOCUMENTS 1,849,042 A * 3/1932 Pickard et al. ..... 210/186
2,191,490 A * 2/1940 Mitterer ..... 137/338
2,358,933 A * 9/1944 Lance ..... 210/186
2,834,469 A * 5/1958 Mitterer ..... 210/181
3,887,467 A * 6/1975 Johnson ..... 210/186
4,717,472 A * 1/1988 Oberg ..... 210/90
5,095,971 A * 3/1992 Hehl ..... 165/47
5,203,832 A * 4/1993 Beatenbough et al. ..... 165/41
5,351,664 A * 10/1994 Rotter et al. ..... 123/196 AB
5,718,281 A * 2/1998 Bartalone et al. ..... 165/41
5,740,772 A * 4/1998 Bluma ..... 123/196 AB
5,901,670 A * 5/1999 Moroi et al. ..... 122/26

FOREIGN PATENT DOCUMENTS

DE 4322979 A1 * 1/1995
EP 773054 A1 * 5/1997

* cited by examiner

*Primary Examiner*—Chong H. Kim

(57) ABSTRACT

An oil filter cooler that has an arrangement of circular fins that are permanently incorporated into the top of an oil filter. These fins allow for an increase of heat dissipation of motor oil as it flows through the oil filter thereby, reducing the temperature of the motor oil.

1 Claim, 2 Drawing Sheets

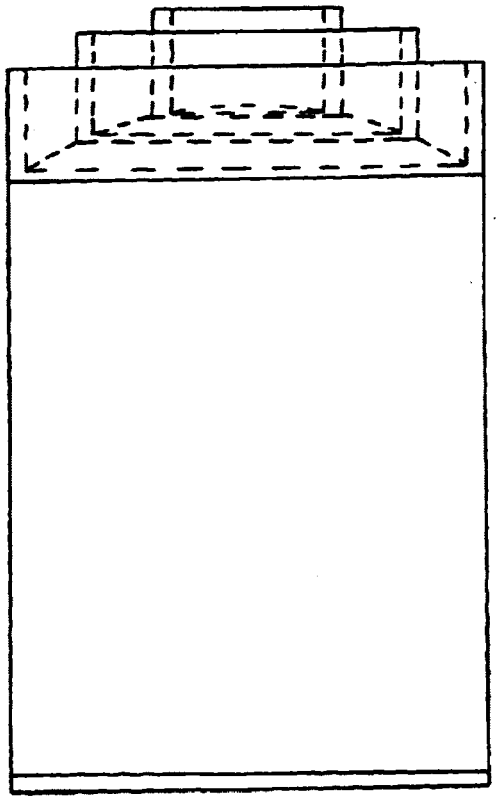

UNITED STATES PATENT AND TRADEMARK OFFICE

CERTIFICATE OF CORRECTION

PATENT NO. : 7,055,654 B2
APPLICATION NO. : 09/948377
DATED : June 6, 2006
INVENTOR(S) : John B. Gasseling It is certified that error appears in the above-identified patent and that said Letters Patent is hereby corrected as shown below:

The title page should be deleted and substitute therefore the attached title page as shown on the attached title page.

Drawings:

Delete drawing sheets 1-2 and substitute therefore the drawing sheets, consisting of Figs. 1-2 as shown on the attached pages.

Col. 2 line 10, should read -- 1986 --

Col. 2 line 20, should read -- SHAPE --

Col. 2 line 40, should read -- 1986 --

This certificate supersedes Certificate of Correction issued September 26, 2006.

Signed and Sealed this

Second Day of January, 2007

JON W. DUDAS
*Director of the United States Patent and Trademark Office*

(12) United States Patent
Gasseling

(10) Patent No.: US 7,055,654 B2
(45) Date of Patent: Jun. 6, 2006

(54) OIL FILTER COOLER

(76) Inventor: John B. Gasseling, 500 East Blvd., Rapid City, SD (US) 57701

( * ) Notice: Subject to any disclaimer, the term of this patent is extended or adjusted under 35 U.S.C. 154(b) by 665 days.

(21) Appl. No.: 09/948,377

(22) Filed: Sep. 5, 2001

(65) Prior Publication Data

US 2003/0042077 A1 Mar. 6, 2003

(51) Int. Cl.
*F01M 5/00* (2006.01)

(52) U.S. Cl. ..... 184/6.22; 123/196 AB

(58) Field of Classification Search ..... 184/6.22, 184/104.1, 104.2, 104.3; 210/186; 165/80.1, 165/916; 123/41.33, 196 A, 196 AB
See application file for complete search history.

(56) References Cited

U.S. PATENT DOCUMENTS 1,849,042 A * 3/1932 Pickard et al. ..... 210/186
2,191,490 A * 2/1940 Mitterer ..... 137/238
2,358,933 A * 9/1944 Lance ..... 210/186
2,834,469 A * 5/1958 Mitterer ..... 210/181
3,887,467 A * 6/1975 Johnson ..... 210/186
4,717,472 A * 1/1988 Oberg ..... 210/90
5,095,971 A * 3/1992 Hehl ..... 165/47
5,203,832 A * 4/1993 Bentenbough et al. ..... 165/41
5,351,664 A * 10/1994 Rotter et al. ..... 123/196 AB
5,718,281 A * 2/1998 Bartalone et al. ..... 165/41
5,740,772 A * 4/1998 Bluma ..... 123/196 AB
5,901,670 A * 5/1999 Moroi et al. ..... 122/26

FOREIGN PATENT DOCUMENTS

DE 4322979 A1 * 1/1995
EP 773054 A1 * 5/1997

* cited by examiner

*Primary Examiner*—Chong H. Kim

(57) ABSTRACT

An oil filter cooler that has an arrangement of circular fins that are permanently incorporated into the top of an oil filter. These fins allow for an increase of heat dissipation of motor oil as it flows through the oil filter thereby, reducing the temperature of the motor oil.

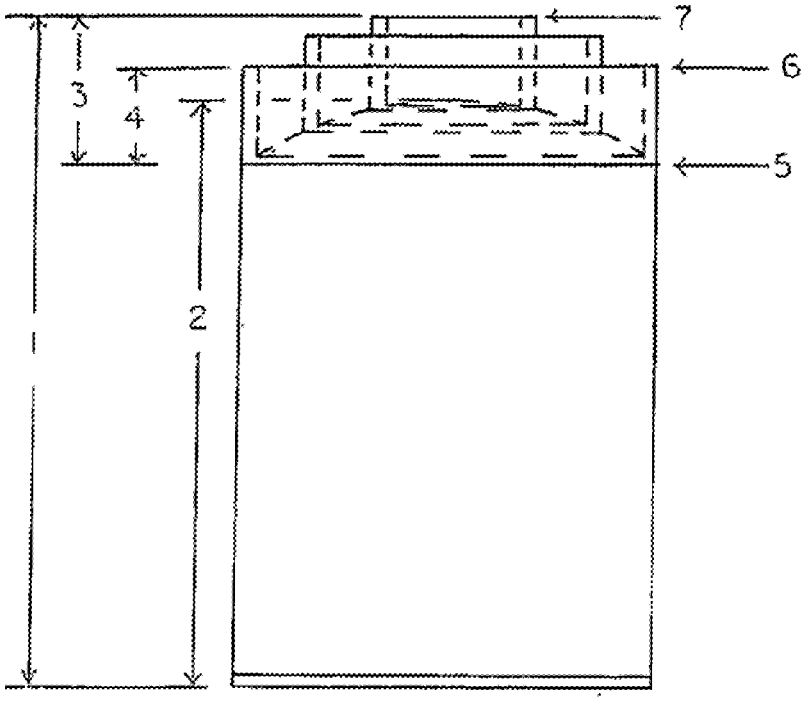

1 Claim, 2 Drawing Sheets